US010478978B2

(12) United States Patent
Peyrot

(10) Patent No.: US 10,478,978 B2
(45) Date of Patent: Nov. 19, 2019

(54) ELECTRIC KNIFE

(71) Applicant: MURE & PEYROT, Bordeaux (FR)

(72) Inventor: Jean-Claude Peyrot, Bordeaux (FR)

(73) Assignee: MURE & PEYROT (FR)

( * ) Notice: Subject to any disclaimer, the term of this patent is extended or adjusted under 35 U.S.C. 154(b) by 0 days.

(21) Appl. No.: 15/824,208

(22) Filed: Nov. 28, 2017

(65) Prior Publication Data

US 2018/0186018 A1 Jul. 5, 2018

(51) Int. Cl.
*B26B 7/00* (2006.01)
*B26B 5/00* (2006.01)
*B26B 29/02* (2006.01)

(52) U.S. Cl.
CPC ..... *B26B 7/00* (2013.01); *B26B 5/00* (2013.01); *B26B 5/001* (2013.01); *B26B 29/025* (2013.01)

(58) Field of Classification Search
CPC ..... B26B 7/00; B26B 29/025; B26B 5/00
See application file for complete search history.

(56) References Cited

U.S. PATENT DOCUMENTS 5,607,265 A * 3/1997 Lane ..... B23D 51/16 144/35.2
7,178,244 B2 * 2/2007 Fossella ..... B26B 5/00 30/162
2006/0053631 A1 3/2006 Fossella
2007/0101580 A1 * 5/2007 Fossella ..... B26B 5/00 30/162
2010/0095534 A1 * 4/2010 Saiz ..... B24B 23/005 30/272.1
2010/0199501 A1 * 8/2010 Hernandez ..... B26B 5/001 30/162
2018/0186018 A1 * 7/2018 Peyrot ..... B26B 5/001

FOREIGN PATENT DOCUMENTS

DE 38 49 974 A1 * 6/1990
EP 3 326 768 A1 * 5/2018
FR 3 059 264 * 6/2018
WO WO 2014/105943 A1 * 7/2014
WO WO 2015/091012 A1 * 6/2015

* cited by examiner

*Primary Examiner* — Hwei-Siu C Payer
(74) *Attorney, Agent, or Firm* — Perman & Green, LLP

(57) ABSTRACT

An electric knife including a knife body, forming a handle housing an electric motor, and a blade holder, received in the handle, carrying a blade and maneuvered by the motor via a device for transforming rotary movement of the motor into alternating movement of the blade holder. The knife body includes a fixed shaft perpendicular to the blade on which the blade holder is mounted and which is positioned so that the blade holder is moved in rotation and to-and-fro relative to the fixed shaft by the motor to impart an oscillatory movement to the blade.

10 Claims, 4 Drawing Sheets

ELECTRIC KNIFE

CROSS REFERENCE TO RELATED APPLICATION

This application claims priority to, and the benefit of, French Application No. 1661645, filed on 29 Nov. 2016, the disclosure of which is incorporated herein by reference in its entirety.

BACKGROUND

1. Field

The presently disclosed embodiment concerns an electric knife, i.e. a knife in which a blade is maneuvered by an electric motor in order to assist the operator in their cutting task.

The presently disclosed embodiment applies in particular to knives of the replaceable blade "box cutter" type.

2. Brief Description of Related Developments

An electric knife of the "box cutter" type is known from United States Publication Nos. 2006/053631 A1 and 2010/199501 A1.

United States Publication No. 2006/053631 A1 describes a knife with a sawtooth blade that is moved to-and-fro along a longitudinal axis of the knife by a gear and lead screw system.

United States Publication No. 2010/199501 A1 for its part describes a knife with a straight-edged blade that is moved to-and-fro along a longitudinal axis of the knife by an annular ring system angularly offset relative to a motor shaft and forming a cam path for a fork including an axial rod for maneuvering the blade.

The above embodiments are based on an axial to-and-fro operating principle that is not satisfactory if it is wished to carry out cutting operations in which the edge of the blade is inclined at an angle less than 90° relative to the surface to be cut, for example to cut cardboard.

SUMMARY

An object of the presently disclosed embodiment is to produce an electric knife better suited to cutting operations in which the blade is inclined relative to the element to be cut at an acute angle, for example between 20° and 70°.

To this end the presently disclosed embodiment proposes an electric knife including a knife body forming a handle housing an electric motor and a blade holder received in the handle, carrying a blade and maneuvered by the motor via a device for transforming rotary movement of the motor into alternating movement of the blade holder; the knife body including a fixed shaft perpendicular to the blade on which the blade holder is mounted and which is positioned so that the blade holder is moved in rotation and to-and-fro relative to said fixed shaft by said motor and imparts an oscillatory movement to the blade.

In the presently disclosed embodiment the blade oscillates or vibrates in a transverse direction in contrast to the prior art in which the blade moves parallel to itself in the manner of a saw.

The blade holder can advantageously be mounted around the fixed shaft by means of a plain bearing or a rolling bearing.

The blade holder having a rear end at the handle end and a front end from which the blade projects, the movement transformation device advantageously includes a rod connected to an output shaft of the motor, eccentric relative to and parallel to the output shaft and adapted to cause the blade holder to oscillate around the fixed shaft.

The rod moved by the output shaft preferably acts alternately on transverse abutments of the blade holder to maneuver the rear end of the blade holder to-and-fro in a direction perpendicular to the edge of the blade and in the plane of the blade.

The rod advantageously acts on the transverse abutments of the blade holder via a rolling bearing centered on the rod and the outer cage of which is positioned between said abutments to impart to the blade holder a continuous sinusoidal oscillatory movement during rotation of the motor shaft.

The rod can in particular consist of a tenon mounted eccentrically on a disk fixed axially to the motor shaft and centered on the motor shaft.

According to one aspect of the disclosed embodiment, the disk is housed in a rolling bearing the outer cage of which is received in a frame.

The frame can in particular be fixed to the motor and in line with the motor.

An advantageous aspect of the disclosed embodiment is that the fixed shaft opposes longitudinal movement of the blade holder relative to the handle.

The knife body can in particular house a rechargeable battery for supplying power to the motor.

The motor is advantageously controlled by an on-off switch on the knife body and the switch can in particular be a spring-loaded pushbutton de-energizing the motor when the pushbutton is released, such as a non-latching pushbutton.

BRIEF DESCRIPTION OF THE DRAWINGS

Other features and advantages of the presently disclosed embodiment will become apparent on reading the following description of one nonlimiting aspect of the disclosed embodiment with reference to the drawings, which show.

DETAILED DESCRIPTION

Figure 1:
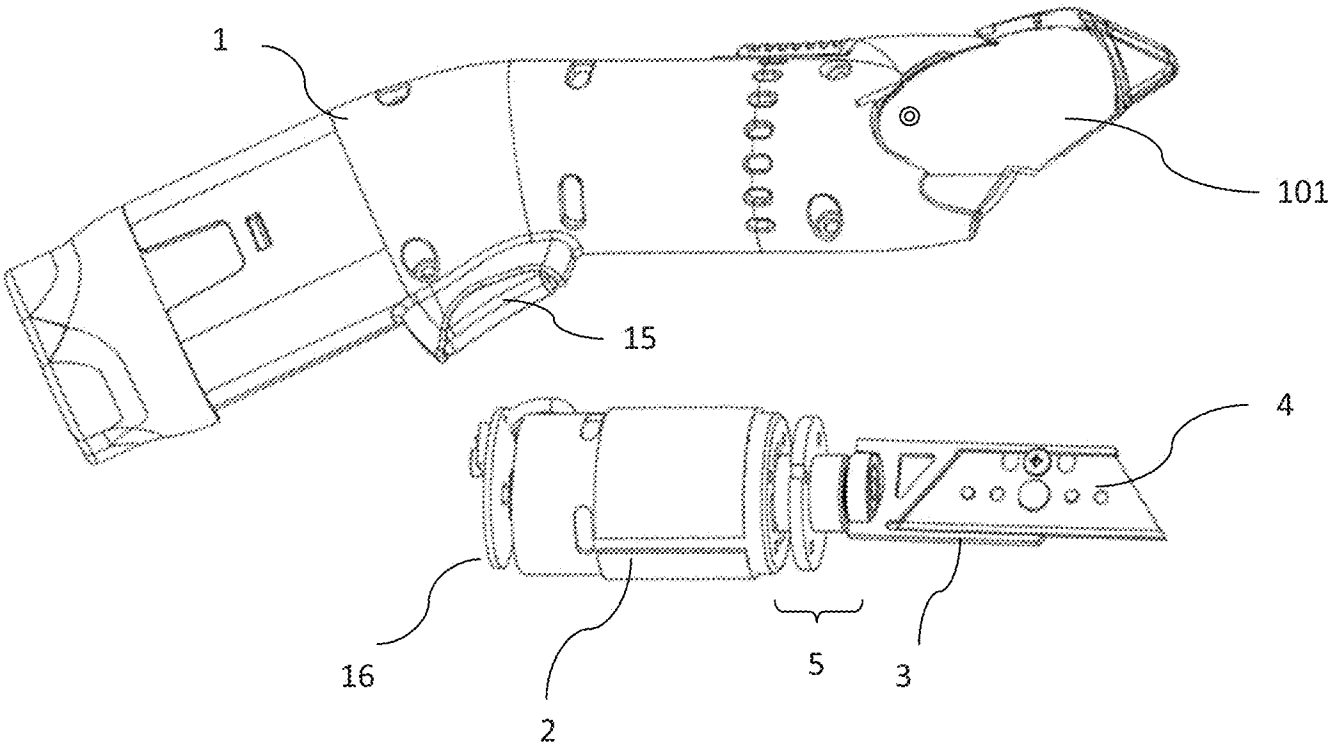
FIG. 1 is a perspective view of an electric knife according to the disclosed embodiment and its mechanism.

A dismantled electric knife according to the presently disclosed embodiment is shown in FIG. 1.

It includes a knife body 1 forming a handle having a longitudinal axis and a transverse axis. In the body of the knife are disposed an electric motor 2, for example a direct current motor having a rotary output shaft, a power supply battery 14 for the motor, an electronic circuit card 16 for controlling the motor and a switch 15 for starting and stopping the motor. At the front of the knife body is mounted a pivoting guard device 101 for covering the blade when the knife is not in use.

The knife includes a blade holder 3 received in the handle and carrying a blade 4. The blade holder has a rear end at the handle end and a front end from which the blade projects.

A movement transformation device 5 described hereinafter connects the motor and the blade holder.

Figure 2:
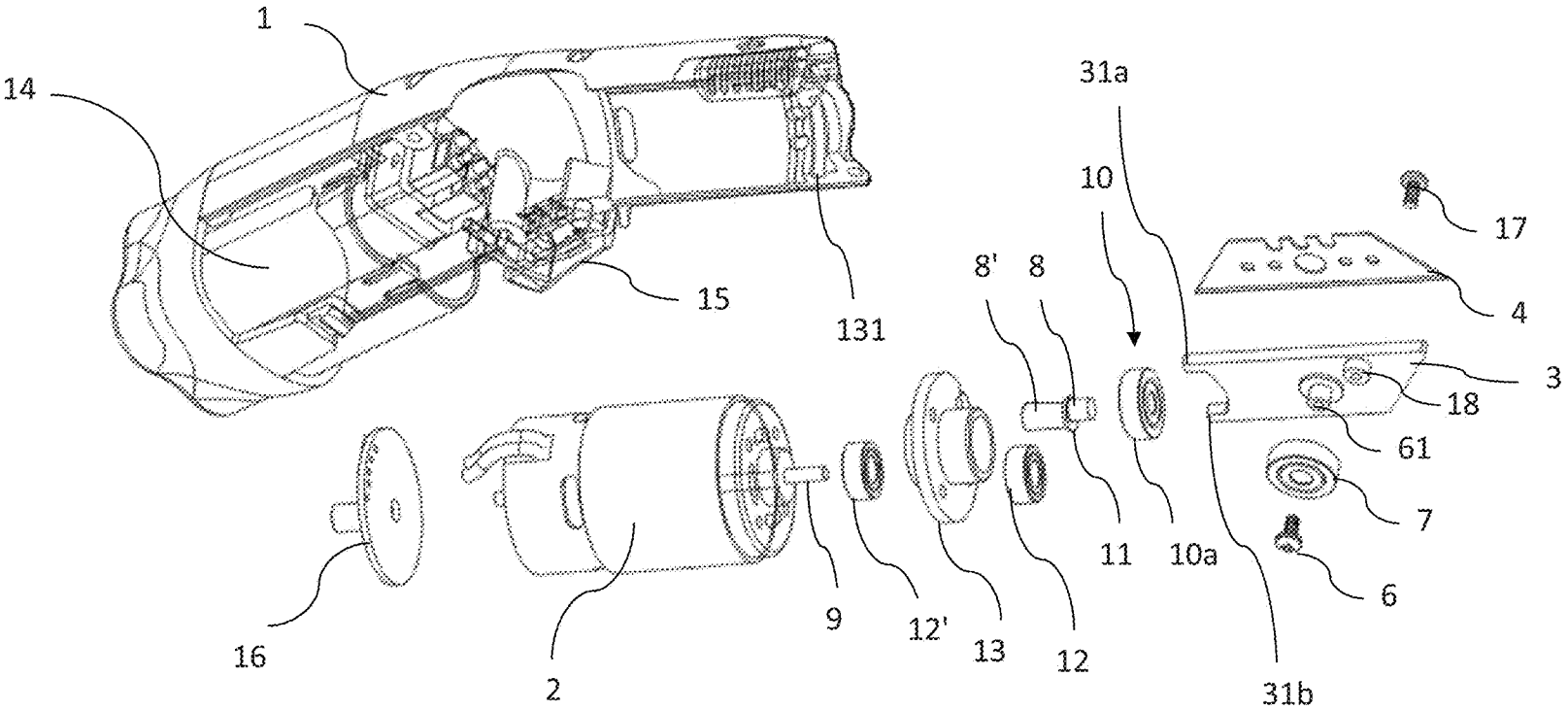
FIG. 2 is an exploded view of the knife from FIG. 1.

In the FIG. 2 exploded view the blade holder is seen to be mounted in the body 1 by means of a rolling bearing 7. The blade holder 3 includes a shaft 61 approximately centered on the blade holder on which the inner cage of the rolling bearing 7 is mounted. A screw 6 clamps said inner cage and constitute a rotation axis of the blade holder.

The outer cage of the rolling bearing 7 is received in the body 1 and, in this form of construction, the blade pivots relative to the body of the knife about the axis consisting of the screw 6 at the center of the rolling bearing 7. A housing 132 receiving the rolling bearing 7 in the body 1 is shown diagrammatically in FIG. 3. The shaft 6 about which the blade holder pivots is perpendicular to the blade.

Referring again to FIG. 2, to enable to-and-fro rotation of the blade holder around said fixed shaft and to impart an oscillatory movement to the blade a device 5 is provided for transforming continuous rotary movement of the motor into alternating rotary movement of the blade holder.

The movement transformation device 5 includes a rod 8 eccentric relative to and connected to the output shaft 9 of the motor by a sleeve 8'. The rod extends along an axis parallel to the axis of the output shaft and effects a circular movement around the axis of the output shaft 9.

The rod 8 moved by the output shaft acts alternately on transverse abutments 31*a*, 31*b* at the level of the rear end of the blade holder 3 via a rolling bearing 10.

The transverse abutments form a fork around the outer cage 10*a* of the rolling bearing 10. The inner cage of the rolling bearing 10 is centered on the rod and the outer cage 10*a* is positioned between the abutments 31*a*, 31*b* to impart an oscillatory movement to the blade holder during rotation of the output shaft 9 of the motor. Alternatively, the rod could act directly on the abutments or the blade holder could include an eccentric cam path in which the rod moves.

The rotary movement of the rod parallel to itself enables to-and-fro maneuvering of the rear end of the blade holder in a direction parallel to the edge of the blade and in the plane of the blade.

At the motor end, the rod 8 is fastened to a disk 11 extended on the side opposite the rod by the sleeve 8' fixed to and centered on the motor shaft 9. In the context of the presently disclosed embodiment producing the rod in the form of a crank can also be envisaged.

To prevent vibrations and to guide the rod correctly, the sleeve 8' is advantageously but not necessarily received in the inner cage of rolling bearings 12, 12' the outer cage of which is set into a housing of an annular frame 13 on either side of the frame.

The annular frame is itself received in a groove 131 in the body 1 of the knife. In this example the frame is fixed to and in line with the motor 2, which has the advantage of being compact and robust, but the frame 13 could equally well be fixed to the knife body in the groove.

An important aspect of the disclosed embodiment is that the fixed shaft 6 opposes longitudinal movement of the blade holder 3 relative to the handle when the knife is operating.

The motor is controlled by an on-off switch 15 on the knife body. This switch can in particular be a spring-loaded pushbutton de-energizing the motor when the pushbutton is released, which is a safety feature in that the motor starts only if the operator depresses the pushbutton and stops as soon as the operator releases the pushbutton.

A battery charging connector or a removable battery in a housing with a cover can be provided.

Figure 3:
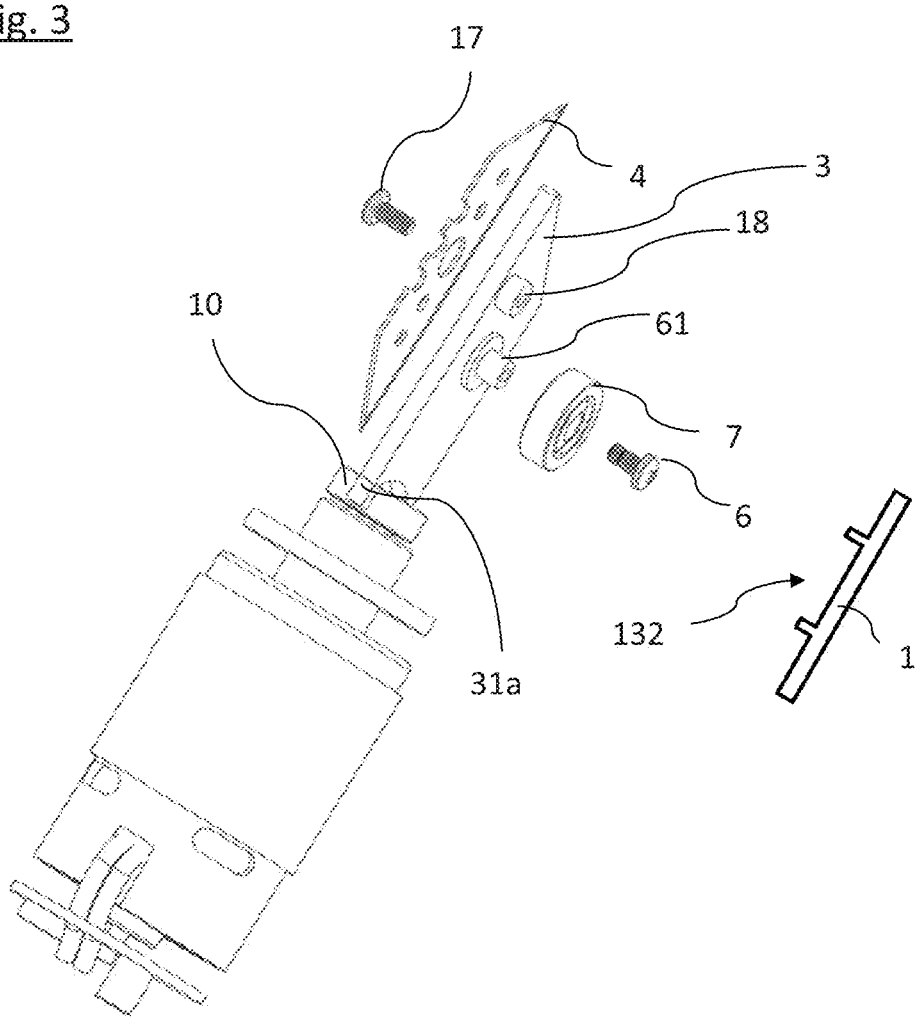
FIG. 3 is a perspective view of the motor and blade holder assembly from FIG. 1.

The blade is mounted on the blade holder in the known manner but, because the blade is subject to vibrations and an oscillatory movement, here the blade is retained on the blade holder by a screw 17 screwed into a threaded hole 18 in the blade holder as shown in FIG. 3.

That figure also shows the assembly comprising the blade and the blade holder, the drive system and the motor from above, which makes the position of the rolling bearing 10 relative to the abutment 31*a* visible. The positioning of the rolling bearing 7 that is fixed to the column 61 by means of the fixing screw 6.

Figure 4:
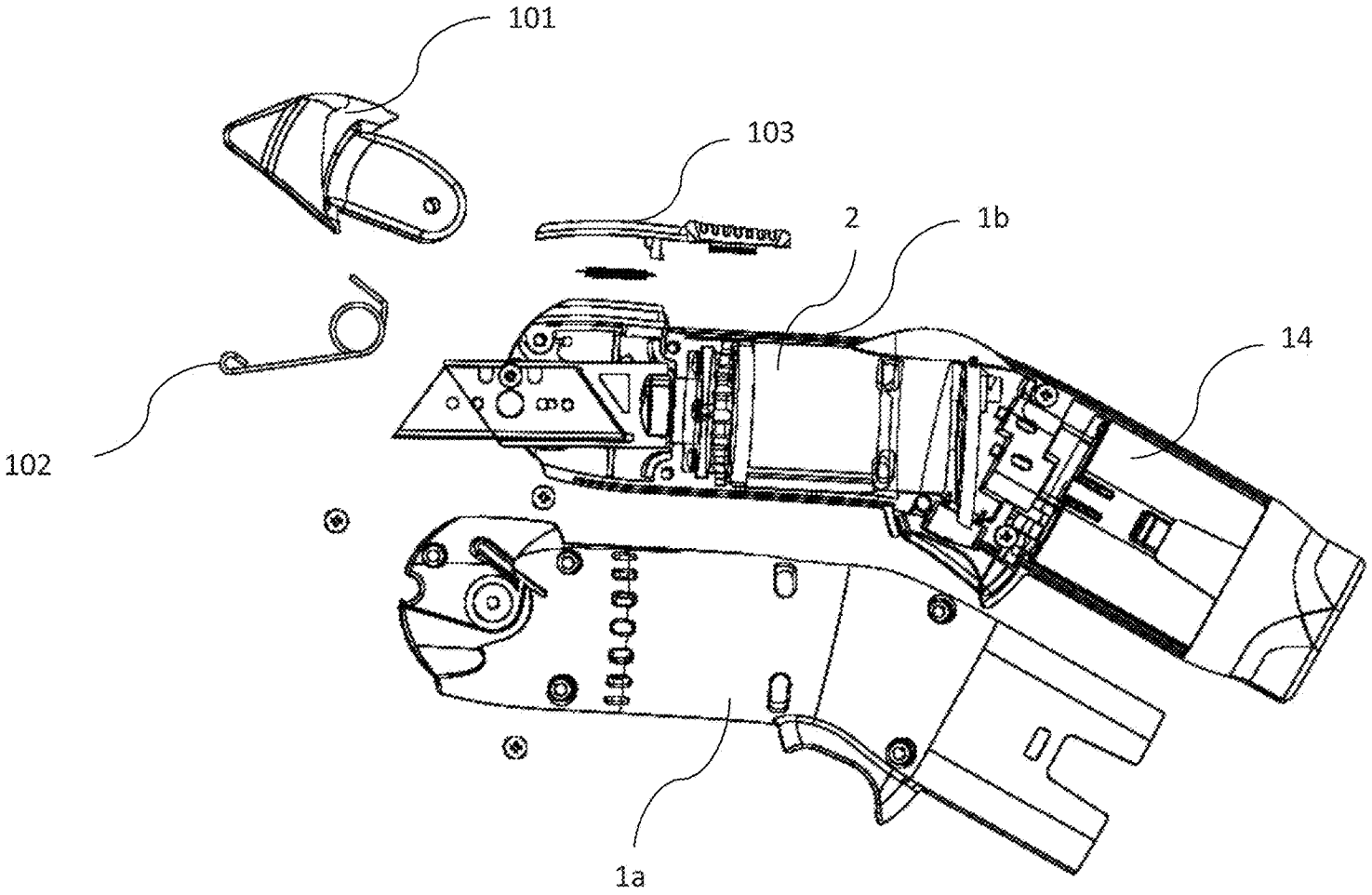
FIG. 4 is an exploded view of the knife from FIG. 1.

To provide a concrete example, the motor can have a power of the order of 170 watts and a rotation speed between 18000 and 20000 revolutions per minute which produces oscillations of the blade at a frequency of 300 to 333 Hz. Since the device is sized to have a movement of the blade of 2 to 3 mm, the maximum speed at the end of blade tip goes from 1.5 to 2 m/s. FIG. 4 shows the dismantled knife from FIG. 1 from a different angle.

This figure shows the two half shells 1*a*, 1*b* in which are positioned the battery 14, which is inserted via the rear end of the knife body, the motor 2, the mechanism driving the blade and the blade holder. This figure shows in more detail the guard device 101 with its return spring 102 and its locking device 103.

The presently disclosed embodiment defined by the claims is not limited to the example shown and in particular the body of the knife can be straight or curved for example.

What is claimed is:

1. An electric knife including a knife body forming a handle housing an electric motor and a blade holder received in the handle, carrying a blade and maneuvered by the motor via a device for transforming rotary movement of the motor into alternating movement of the blade holder; wherein the knife body includes a fixed shaft perpendicular to the blade on which the blade holder is mounted and which is positioned so that the blade holder is moved in rotation and to-and-fro relative to said fixed shaft by said motor to impart an oscillatory movement to the blade.

2. The electric knife as claimed in claim 1, in which the blade holder is mounted around the fixed shaft by means of a plain bearing or a rolling bearing.

3. The electric knife as claimed in claim 1, in which the blade holder has a rear end and a front end from which the blade projects, the movement transforming device includes a rod connected to an output shaft of the motor, eccentric relative to and parallel to the output shaft, and in which the rod moved by the output shaft acts alternately on transverse abutments of the blade holder to maneuver the rear end of the blade holder to-and-fro in a direction perpendicular to a cutting edge of the blade and in the plane of the blade.

4. The electric knife as claimed in claim 3, in which the rod acts on the transverse abutments of the blade holder via a rolling bearing centered on the rod and the outer cage of which is positioned between said abutments to impart to the blade holder a continuous sinusoidal oscillatory movement during rotation of the output shaft.

5. The electric knife as claimed in claim 3, in which the rod consists of a tenon mounted eccentrically on a disk fixed axially to the output shaft and centered on the output shaft.

6. The electric knife as claimed in claim 5, in which the disk is housed in a rolling bearing the outer cage of which is received in a frame fixed to the motor and in line with the motor.

7. The electric knife as claimed in claim 1, in which the fixed shaft opposes longitudinal movement of the blade holder relative to the handle.

8. The electric knife as claimed in claim 1, in which the knife body houses a rechargeable battery for supplying power to the motor.

9. The electric knife as claimed in claim 1, in which the motor is controlled by an on-off switch on the knife body.

10. The electric knife as claimed in claim 9, in which the switch is a spring-loaded pushbutton de-energizing the motor when the pushbutton is released.

* * * * *